US005412892A

United States Patent [19]

Filippakis

[11] Patent Number: 5,412,892

[45] Date of Patent: May 9, 1995

[54] SCROLLING DISPLAY SIGN FOR VEHICLES

[76] Inventor: John Filippakis, 10114 Bayard Ct., Orlando, Fla. 32836

[21] Appl. No.: 118,400

[22] Filed: Sep. 9, 1993

[51] Int. Cl.[6] ..... G09F 11/18; G09F 21/04

[52] U.S. Cl. ..... 40/471; 40/592

[58] Field of Search ..... 40/471, 592, 522, 518

[56] References Cited

U.S. PATENT DOCUMENTS

| | | | |
|---|---|---|---|
| D. 245,940 | 9/1977 | George . | |
| 1,000,318 | 8/1911 | Armstrong | 40/471 |
| 1,578,039 | 3/1926 | Kelly | 40/471 |
| 1,945,571 | 2/1934 | Samaras et al. | 40/471 |
| 3,616,554 | 11/1971 | Singer et al. . | |
| 3,919,794 | 11/1975 | Hunter, Jr. . | |
| 4,005,535 | 2/1977 | Davis . | |
| 4,073,081 | 2/1978 | Hunter, Jr. | 40/470 |
| 4,201,002 | 5/1980 | Barton | 40/524 |
| 4,667,428 | 5/1987 | Elmer | 40/592 |
| 4,671,004 | 6/1987 | Berg | 40/592 |
| 4,995,183 | 2/1991 | Aiken, Sr. | 40/518 |
| 5,003,717 | 4/1991 | Trame et al. | 40/471 X |
| 5,088,219 | 2/1992 | Toraby-Payhan | 40/471 |

FOREIGN PATENT DOCUMENTS

| | | | |
|---|---|---|---|
| 475773 | 6/1915 | France | 40/471 |
| 2437041 | 5/1980 | France | 40/471 |
| 2448203 | 10/1980 | France | 40/471 |
| 23824 | of 0000 | United Kingdom | 40/471 |
| 2131218 | 6/1984 | United Kingdom | 40/471 |

*Primary Examiner*—Kenneth J. Dorner
*Assistant Examiner*—Joanne Silbermann
*Attorney, Agent, or Firm*—Richard C. Litman

[57] ABSTRACT

A display sign for use on vehicles such as taxis and the like, includes dispensing and takeup rollers containing a strip of material having a series of advertising and/or other messages thereon. The housing for the device has a three dimensional planform, with the advertising display strip being installed immediately within the transparent peripheral sides of the device and thereby providing for the omnidirectional display of messages on the display strip. At least one motor provides power for the takeup and dispensing reels, allowing the device to display a series of messages from one end of the rolled display strip to the other, before being reversed. An automated timer device may be included to cause the display strip to pause intermittently, thereby allowing a message displayed thereon to be communicated to viewers. The device may include internal illumination and a translucent display strip to provide for the backlighting of the messages. Electrical power may be supplied from the vehicle to which the device is attached.

9 Claims, 2 Drawing Sheets

SCROLLING DISPLAY SIGN FOR VEHICLES

FIELD OF THE INVENTION

The present invention relates generally to advertising signs and the like, and more specifically to an illuminated sign for installation on a motor vehicle and having a three dimensional planform and providing essentially an omnidirectional view of scrolling, changeable messages about substantially the entire periphery of the sign.

BACKGROUND OF THE INVENTION

Advertising messages are well known, and advertising display messages were developed very early in the history of the motorized passenger vehicle, particularly for taxis and the like. Somewhat later the concept of illumination (both front and back lighted) was developed for such signs, furthering their utility for operations in darkness and in poorly lighted areas. However, one defect of almost all such signs is their essentially two dimensional nature, in which the message(s) is/are viewable only from the sides of the vehicle. This eliminates the promotion of the message from either the direct front or rear of the sign and vehicle, which limits the exposure of the message to persons particularly in vehicles following the taxi or vehicle carrying the message.

Moreover, such messages are nearly universally fixed in place, which causes viewers of the message to lose interest rapidly. In today's fast paced world, it is important to provide a message(s) or display(s) which attract the interest of potential viewers and can hold that interest through an interesting and/or changing display.

The need arises for an advertising or display device installable upon a vehicle, which device provides for the omnidirectional display of a message or messages. The device must also provide for a changeable message or messages, and further be essentially automated once initially activated in order to avoid the distraction of the vehicle driver. Finally, the device must also provide illumination for the message(s) displayed, in order to provide utility under most all conceivable conditions.

DESCRIPTION OF THE PRIOR ART

U.S. Pat. No. 3,616,554 issued to Karl Singer et al. on Nov. 2, 1971 discloses a Changeable Message Outdoor Advertising Sign having a sheet message medium or roll running between two rollers. The device is directed to use as an outdoor billboard, and as such incorporates various features in keeping with that environment such as providing for viewing from only a single side. The rollers are disposed horizontally in the sign, so the message scrolls vertically; such an arrangement is unsuitable for use in the environment of the present invention. No illumination means is disclosed.

U.S. Pat. No. 3,919,794 issued to E. Tait Hunter, Jr. on Nov. 18, 1975 discloses a Multiple Message Sign Apparatus comprising a plurality of parallel and contiguous parallelogram cross section elements, which are rotatable through two different positions. The device is relatively complex, having numerous moving components and linkages therefor, and is capable of displaying only two messages on each side of the two opposed faces. No omnidirectional display is provided, nor is any illumination means.

U.S. Pat. No. 4,005,535 issued to James F. Davis on Feb. 1, 1977 discloses a Progressively Revealed Display having a plurality of generally horizontally disposed movable strips with alternating opaque and transparent areas, which correspondingly alternatingly cover and expose a series of messages. Some of the embodiments disclose an omnidirectional display, but due to the need to conceal the message at times, the path(s) of the movable strip(s) is considerably more complex than the essentially peripheral path of the message(s) of the present invention. Moreover, the messages themselves are in motion in the present invention, rather than being periodically concealed behind a movable strip(s), thus providing for continual viewing and changing messages, unlike the Davis device.

U.S. Pat. No. 4,073,081 issued to E. Tait Hunter, Jr. on Feb. 14, 1978 discloses a Changeable Message Sign With Single Message Display Opening. The mechanism is similar to that of the patentee's earlier '794 patent discussed above, but provides only a single viewing face and two interchangeable messages.

U.S. Pat. No. 4,201,002 issued to Edson K. Barton on May 6, 1980 discloses a Continuous Visual Display Apparatus comprising an endless loop of material which passes behind a flat plate viewing window. The motorized means used fail to provide for periodically stopping the message; the loop is in continuous operation, unlike the present invention. Moreover, the message is scrolled vertically on horizontal rollers, which arrangement is unsuitable in the environment of the present invention.

U.S. Pat. No. 4,995,183 issued to Robert B. Aiken, Sr. on Feb. 26, 1991 discloses a Scrolling Sign With Improved Web Guide. The device incorporates multiple webs of material in series, and driven by several motorized rolls. The device is incapable of providing a single continuous message, as can the present invention, and moreover cannot provide an omnidirectional display as in the case of the present invention.

U.S. Pat. No. 5,088,219 issued to Reza Toraby-Payhan on Feb. 18, 1992 discloses a Scrolling Display Device directed to essentially the same environment as the Singer device discussed above, i.e., that of a comparatively large sign in an outdoor billboard. The device permits viewing from only two sides, as in a standard billboard, and any message displayed cannot be read from the edges of the device.

Finally, U.S. Pat. No. D-245,940 issued to James R. George on Sep. 27, 1997 discloses a Combined Taxi Light And Illuminated Advertisement Display. The device appears to provide for viewing a message therein from only two sides, rather than the omnidirectional view provided by the present invention, and moreover no disclosure is made of any means for automatically changing the message therein.

None of the above noted patents, taken either singly or in combination, are seen to disclose the specific arrangement of concepts disclosed by the present invention.

SUMMARY OF THE INVENTION

By the present invention, an improved display sign for use on taxis and the like is disclosed.

Accordingly, one of the objects of the present invention is to provide an improved display sign which provides a three dimensional planform for the display, thus providing for omnidirectional viewing of any message displayed therein.

Another of the objects of the present invention is to provide an improved display sign which includes illumination means therein for the backlighted illumination of the message(s) displayed therein.

Yet another of the objects of the present invention is to provide an improved display sign which provides for the horizontal scrolling of messages about a plurality of vertical rollers, with the message display being disposed substantially about the periphery of the device.

Still another of the objects of the present invention is to provide an improved display sign which includes automatic timer delay means providing for the automatic intermittent stopping of the message for viewing, and the automatic scrolling of the message to display a subsequent message after a given elapsed period of time, without need for manual control.

A further object of the present invention is to provide an improved display sign which may provide a multitude of messages by means of the roller take up system used for storing the messages.

An additional object of the present invention is to provide an improved display sign which may be provided in a variety of geometrically shaped planforms.

A final object of the present invention is to provide an improved display sign for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 1:
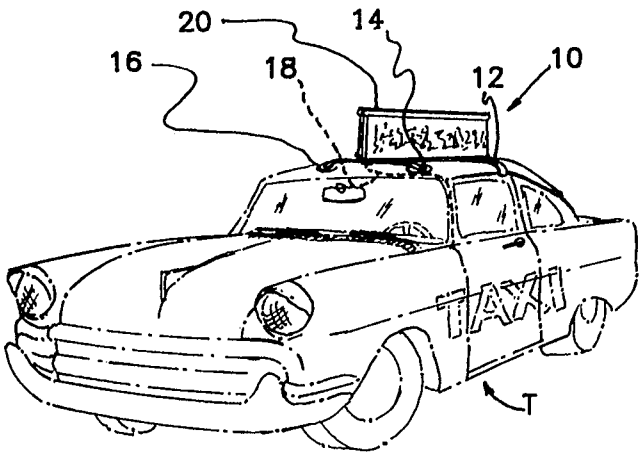
FIG. 1 is a perspective view of a first embodiment of the present invention installed on a taxi vehicle, showing the general configuration and attachment means.

Referring now particularly to FIG. 1 of the drawings, the present invention will be seen to relate to a message display sign 10 for installation on and use with vehicles, such as a taxicab T or other vehicle. FIG. 1 also disclosed means for securing the sign 10 to a vehicle T, such as straps 12 which secure to a door edge, or a suction cup 14 or magnetic means 16 for securing to the roof surface of the vehicle T. Other, more permanent means of attachment (e.g., screws, bolts, adhesives, etc.) may be used alternatively, if desired. Also disclosed in FIG. 1 is an electrical power cord 18, which cord 18 may be run along the exterior of the vehicle T or installed within the structure of the vehicle T as shown. In the event that the sign 10 does not utilize a self contained battery pack for electrical power, the power cord 18 may be used to supply electrical power from the electrical system of the vehicle T for the lighting and other mechanism of the sign 10, which will be described below.

Figure 2:
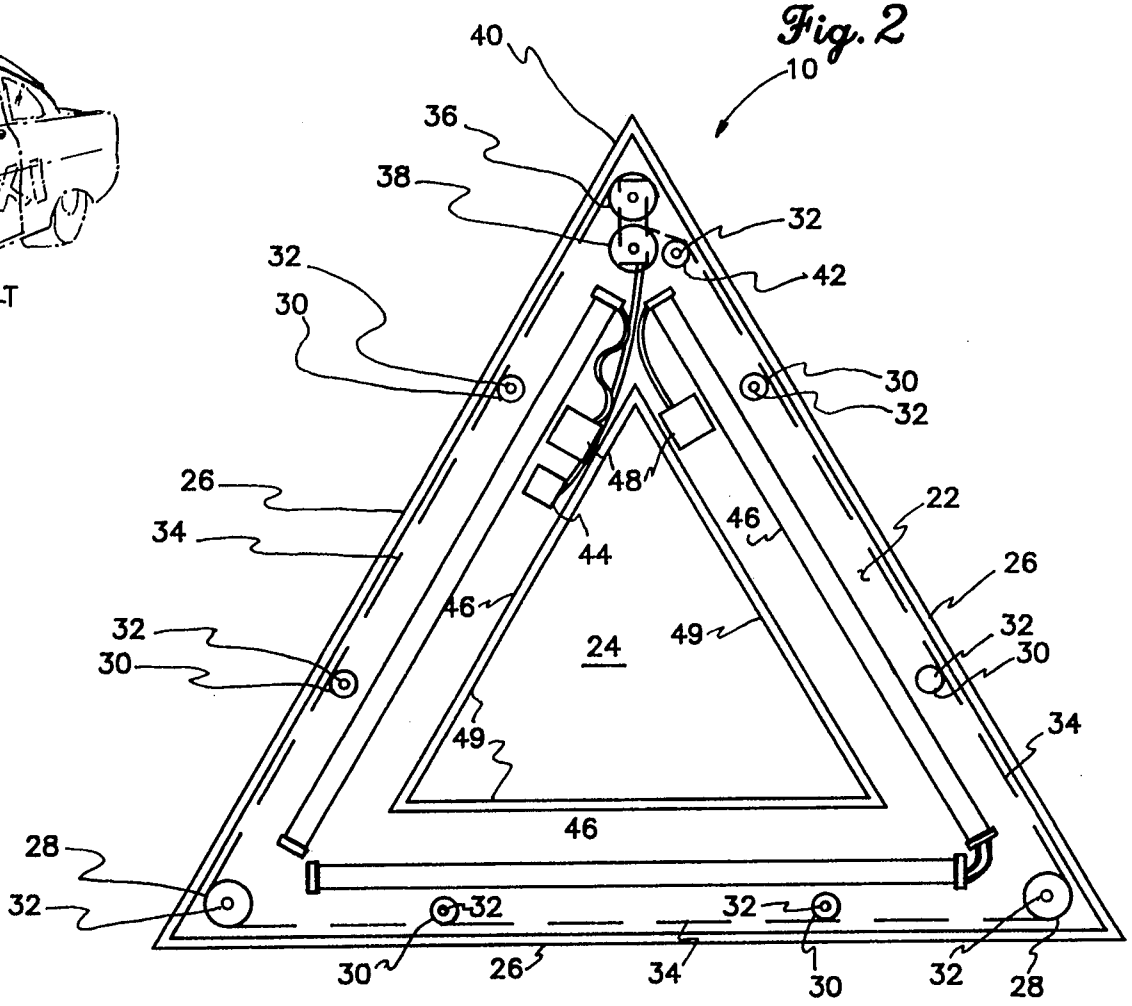
FIG. 2 is a top plan view of the generally triangular first embodiment of the present invention showing the top plate or cover removed and the interior features thereof.

FIG. 2 provides a detailed view of the interior structure and components of the sign 10 of FIG. 1. It will be understood that the top plate 20 (shown in FIG. 1) has been removed in FIGS. 2, 3A and 3B in order to show the interior components and structure of these embodiments more clearly. Sign 10 includes a base plate 22, having a general geometric form similar to the overall shape of the sign 10, i.e., triangular in the case of sign 10. Base plate 22 may span the central area 24, as may the top plate 20, or alternatively be left open across the central area 24. Generally vertical panels 26 formed of transparent sheet material (e.g., clear acrylic or glass) extend between the base plate 22 and the top plate 20, to provide a peripheral enclosure for the structure therein. The top plate 20, base plate 22, and side panels 26 form a housing for the mechanism contained therein. A series of corner rollers 28 and side rollers 30 also extend between the top plate 20 and the base plate 22 and provide control of the peripheral path of the flexible scrolling sign display strip or sheet 34 sandwiched between the peripheral panels 26 and the rollers 28 and 30. Rollers 28 and 30 rotate on fixed pins 32 installed between the top and base plates 20 and 22.

The sheet or strip 34 is formed of a preferably thin and translucent material (e.g., Mylar-TM) in the manner of moving picture films and the like, although other material may be used as desired or required. Preferably, the strip 34 is translucent, in order to provide for the backlighting of a message or other indicia thereon, as will be explained further below. First and second motorized reels 36 and 38 alternatingly serve as dispensing and takeup reels for the display sheet 34. Reels 36 and 38 will be seen to be installed at one apex 40 of the sign 10, with the second reel 38 installed toward the center of the sign 10 and behind the first reel 36, in order to maximize the field of view of the display sheet 34 through the transparent side panels 26. The two motorized reels 36 and 38 are powered by at least one motor and are cooperatingly interconnected for the dispensing or takeup of the display sheet 34 by suitable drive means (e.g., belts, etc.), as in the case of audio and video tape players.

The above described mechanism will be seen to provide for the dispensing of a display strip 34 wound upon one of the reels 36 or 38 until the strip 34 reaches the end of its travel, whereupon reversal means (e.g., an idler wheel 42 detecting the tension change as the strip 34 reaches the end, or sprocket, light or magnetic means) in the manner of that for an audio or video tape player provides for the reversal of the motor(s) in order to cause the strip 34 to reverse and rewind to the other reel. An intermittent timer device 44 is connected to the motorized reels 36 and 38 in order to provide for the advance of the strip 34 to display a new message or design. The timer device 44 provides for the adjustability of the pause time, allowing viewers to read or absorb the message or display provided by the strip 34 in its pause or rest mode, before automatically scrolling to the next message on the strip 34. The advance means may determine the proper pause point for the alignment of the message in each face of the sign 10 by e.g., sprocket holes selectively spaced at the edge of the strip 34, or magnetic, light or other means.

The present invention also provides for the backlighting of the strip 34, as noted above. A plurality of lights are installed immediately behind the display strip 34, to illuminate the strip 34 from the back and through the transparent side panels 26, and provide for its viewing in adverse lighting conditions. While the lighting means may be incandescent lights, a series of fluorescent tubes 46 and a power supply/supplies 48 may be used to provide more uniform lighting along each of the side panels 26. An additional reflective panel 49 may be provided in back of each of the lights 46 in order to provide more efficient backlighting of the display strip 34.

Figure 3A:
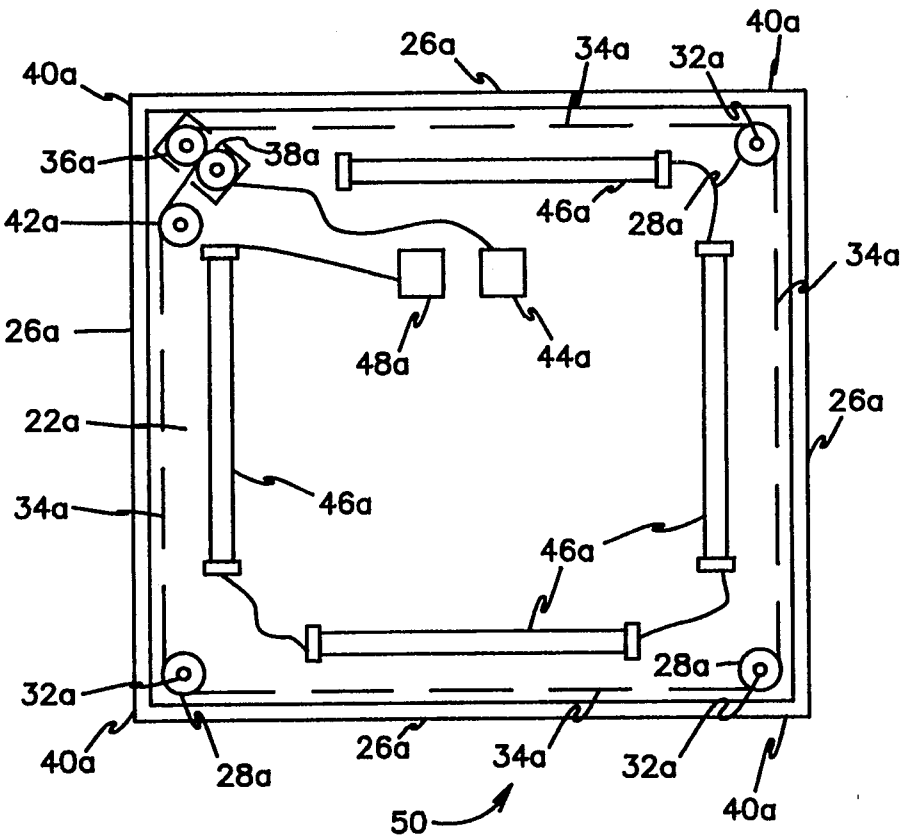
FIG. 3A is a top plan view of the second embodiment showing the top cover plate removed, with a generally rectangular planform.

FIG. 3A discloses an alternative second embodiment 50 of the present invention. While the embodiment of sign 10 of FIGS. 1 and 2 provided only three sides 26 for the display of a message therein, the embodiment of FIG. 3A discloses a sign 50 having four side panels **26*a*. It will be seen that the present invention is adaptable to virtually any feasible polygonal geometric planform, with the three sided embodiment of FIGS. 1 and 2 representing one variation and the four sided embodiment of FIG. 3A representing another of the possible variations in the present invention. While the sign 50 of FIG. 3A is generally in the form of a quadrilateral polygon, more specifically the apices 40*a* are at right angles to provide a rectangular planform, and the side panels 26*a*** are equal in length to provide a square planform.

Sign 50 is constructed generally along the lines of the sign 10 of FIGS. 1 and 2 discussed above, having a top plate (not shown), a bottom or base plate **22*a*, a plurality of transparent side panels 26*a* sandwiched therebetween, and a corner roller 28*a* supported upon a fixed pin 32*a* extending between the top plate and the bottom plate 22*a* at each apex 40*a*. In the case of the upper left apex as shown in FIG. 2, the first reel 36*a* may serve as the corner roller, in order to maximize the peripheral span traveled by the display strip 34*a*; the second reel 38*a* is disposed inwardly of the first reel 36*a*, in the manner of the reels 36 and 38 of the triangular first embodiment of FIGS. 1 and 2. While not shown in FIG. 2, it will be understood that additional side rollers may be installed in order to maintain the alignment of the display strip 34*a* immediately adjacent the inner surface of the transparent side panels 26*a***, if required.

In the quadrilateral embodiment of sign 50 of FIG. 3A, the display strip **34*a* extends from the first reel 36*a* and around the three corner rollers 28*a*, and back over an idler wheel or roller 42*a* and thence to the second reel 38*a*, similar to the path of the display strip 34 of FIG. 2, but with the addition of another corner in the path. The display strip 34*a* may run to its maximum extension from one of the reels 36*a* or 38*a*, and thence be reversed by means of the idler wheel 42*a* sensing the tension on the display strip 34*a* as it reaches the end of the dispensing reel, or other suitable means, in the manner of operation of the sign 10 of FIGS. 1 and 2. Lighting means is provided by a plurality of lights, such as the fluorescent tubes 46*a* installed immediately behind the path of the display strip 34*a* and the associated power supply/supplies 48*a*, in the manner of sign 10**.

A timer control **44*a* provides for the intermittent operation of the reels 36*a* and 38*a*, in the manner of the operation described for the sign 10 of FIGS. 1 and 2. The timer control 44*a* provides for the advancing of the display strip 34*a* periodically, in order to display a new message, in the manner described above for the sign 10 of FIGS. 1 and 2. Means may be provided (timer, sprocket holes, etc., as described above for sign 10) in order to assure that the display strip 34*a* advances a distance precisely equal to its span about the corner rollers 28*a* and first reel 36*a*, thus assuring that a new message is properly positioned about the periphery of the sign 50. Preferably, the same message is displayed on each of the sides of the sign 50 of FIG. 3A, just as in the case of sign 10 of FIGS. 1 and 2; sign 10 would provide three consecutive identical messages, while sign 50 would provide four consecutive identical messages. Thus, a viewer(s) in any direction from the signs 10 or 50** will be able to view the same message, assuring that the message is not missed by a viewer in any direction.

Figure 3B:
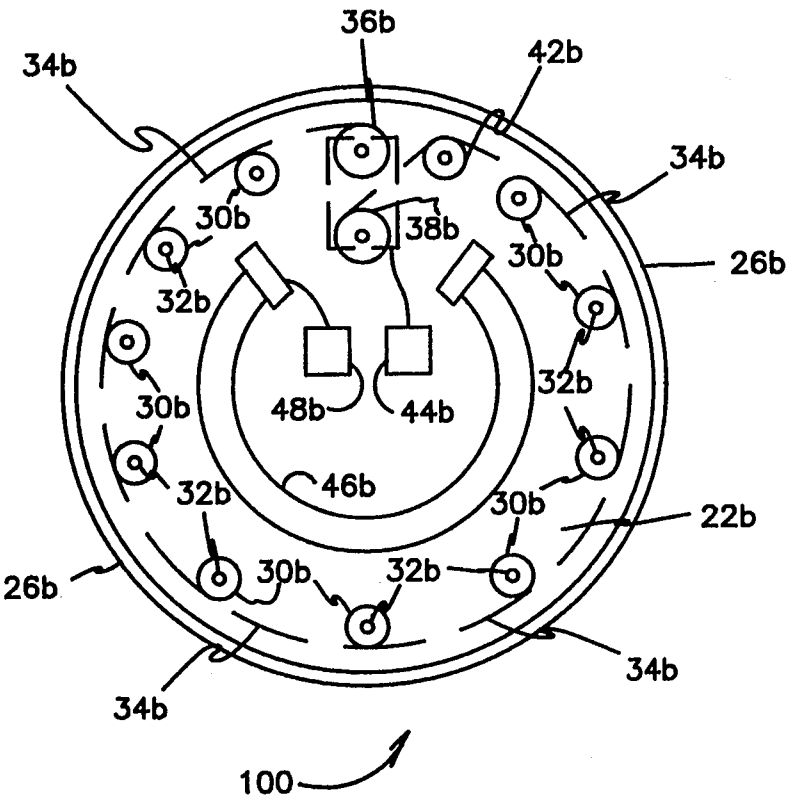
FIG. 3B is a top plan view of the third embodiment with the top cover plate removed, showing a generally circular configuration and the interior structure therefor.

FIG. 3B discloses yet another variation, in which a sign 100 having a curved, rounded or circular planform is provided. Display sign 100 is preferably constructed in the manner of the signs 10 and 50 discussed above, having a base plate **22*b* and a top plate (not shown), with a peripheral curved or circular transparent side panel 26*b* and a series of side rollers 30*b* disposed upon pins 32*b* sandwiched therebetween. Preferably, a greater number of side rollers 30*b* are provided for the embodiment of sign 100 of FIG. 3B, (e.g., ten in the example of FIG. 3B, in addition to the first reel 36*b* and the idler roller or wheel 42*b*) in order to conform substantially to the curved surface of the side panel 26*b***.

As in the case of the signs 10 and 50 of FIGS. 1, 2 and 3A, an intermittent timer control **44*b* is provided for periodically stopping the display sheet 34*b* so a message thereon may be easily observed by viewers surrounding the sign 100. The operation of the timer control 44*b* is essentially the same as that described above for signs 10 and 50, as is the forward and reverse operation of the motorized first and second reels 36*b* and 38*b*. Lighting means may also be provided, as in the embodiments discussed above. However, in the case of the sign 100, it may be more efficient to provide one or more fluorescent tubes 46*b* having a circular configuration, so as to distribute the light output more evenly within the curved side panel 26*b*. A power supply 48*b* provides electrical power for the curved fluorescent tube 46*b*, similar to the operation of the lighting for signs 10 and 50** discussed above.

The various embodiments 10, 50 or 100 of the present invention provide an optimum means of displaying advertising, information or other matter omnidirectionally to persons in the vicinity of a taxi or other vehicle upon which one of the signs 10, 50 or 100 may be installed. The automatic, intermittent timer means allows the message to be scrolled to a desired point and stopped, whereupon the message is legible to persons in any direction from the sign for a predetermined period of time. The timer may then actuate the takeup reel to advance the scrolling display sheet to the next message and stopped, whereupon the next message will be displayed omnidirectionally about the sign. The lighting means may be automatically actuated when power is applied to the sign, or alternatively may be actuated by a separate circuit from the vehicle lighting when that lighting is turned on. Scrolling sheets may be changed as desired, in the manner of changing camera film.

It is to be understood that the present invention is not limited to the sole embodiments described above, but encompasses any and all embodiments within the scope of the following claims.

I claim:

1. A display sign comprising:

a base plate, a top plate, and at least one peripheral transparent side plate sandwiched therebetween, said base plate, said top plate, and said at least one peripheral transparent side plate defining a housing having a three dimensional polygonal shape;

a plurality of pins disposed within said housing and extending between said top plate and said base plate, with said pins each having a roller installed thereon and disposed adjacent said peripheral transparent side plate;

a scrolling display sheet disposed about said rollers, with said rollers providing guidance for said scrolling display sheet along a path substantially about the periphery of said housing and between said rollers and said peripheral transparent side plate, and said display including a message having a first message portion and a second message portion;

first and second reels disposed within said housing and including motorized means for dispensing said scrolling display sheet, with said first reel being installed adjacent said at least one peripheral transparent side plate at a corner of said polygonal shape, and said second reel being installed adjacent said first reel and inwardly towards a geometric center of said housing, said scrolling display sheet being scrolled from said first reel to said second reel to display said message thereon and visible through said at least one peripheral transparent side plate;

means providing for the reversal of said first and second reels, whereby the direction of travel of said scrolling display sheet is reversed; and a timer controlling said motorized means to pause said scrolling display sheet to allow said first message portion to be displayed for a predetermined period of time before said second message portion is displayed.

2. The display sign of claim 1 further comprising:

a vehicle having a rooftop;

said base plate being configured to be attached to said rooftop;

an electrical power cord providing electrical power from the vehicle upon which said display sign is installed, to at least said reels including said motorized means providing for the dispensing and takeup of said scrolling sheet thereon.

3. The display sign of claim 1 wherein:

said housing includes electrical illumination means disposed therewithin and said scrolling display sheet is translucent, whereby said illumination means provides for the backlighted illumination of said scrolling display sheet and indicia thereon.

4. The display sign of claim 3 including:

an electrical power cord providing electrical power from the vehicle upon which said display sign is installed, to at least said electrical illumination means disposed within said housing.

5. The display sign of claim 3 wherein:

said electrical illumination means comprises fluorescent illumination.

6. The display sign of claim 1 wherein: said polygonal shape is a triangle.

7. The display sign of claim 1 wherein: said polygonal shape is a rectangle.

8. The display sign of claim 1 wherein: said polygonal shape is substantially square.

9. A display sign comprising:

a base plate, a top plate, and a transparent side plate sandwiched therebetween;

a housing defined by said base plate, said top plate, and said transparent side plate; said housing having a three dimensional circular shape.

a plurality of pins disposed within said housing and extending between said top plate and said base plate, each pin of said plurality of pins having a roller installed thereon and disposed adjacent said transparent side plate;

a scrolling display sheet disposed about said rollers, with said rollers providing guidance for said scrolling display sheet along a path substantially about the periphery of said housing and between said rollers and said transparent side plate, and said display including a message having a first message portion and a second message portion;

first and second reels disposed within said housing;

means for dispensing said scrolling display sheet;

said first reel installed adjacent said at least one peripheral transparent side plate at a corner of said polygonal shape, and said second reel installed adjacent said first reel and inwardly towards a geometric center of said housing, said scrolling display sheet being scrolled from said first reel to said second reel to display said message thereon and visible through said transparent side plate;

means reversing the direction of travel of said scrolling display sheet; and a timer controlling said means for dispensing to pause said scrolling display sheet to allow said first message portion to be displayed for a predetermined period of time before said second message portion is displayed.

* * * * *